US010973087B2

(12) United States Patent
Wang et al.

(10) Patent No.: US 10,973,087 B2
(45) Date of Patent: Apr. 6, 2021

(54) E-CIGARETTE WITH A PLURALITY OF HEATING COMPONENTS

(71) Applicant: O-NET AUTOMATION TECHNOLOGY (SHENZHEN) COMPANY LIMITED, Guangdong (CN)

(72) Inventors: Cheng Wang, Guangdong (CN); Zhidong Zeng, Guangdong (CN); Mingjing Hu, Guangdong (CN); Bo Zhou, Guangdong (CN)

(73) Assignee: O-NET AUTOMATION TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 371 days.

(21) Appl. No.: 16/046,959

(22) Filed: Jul. 26, 2018

(65) Prior Publication Data

US 2018/0332896 A1 Nov. 22, 2018

Related U.S. Application Data

(63) Continuation of application No. PCT/CN2016/076249, filed on Mar. 14, 2016.

(30) Foreign Application Priority Data

Feb. 1, 2016 (CN) ..... 201610070624.X

(51) Int. Cl.

| | |
|---|---|
| ***A24F 13/00*** | (2006.01) |
| ***H05B 1/02*** | (2006.01) |
| ***A24F 7/00*** | (2006.01) |
| ***H05B 3/44*** | (2006.01) |
| ***H05B 3/80*** | (2006.01) |

(52) U.S. Cl.

CPC ..... *H05B 1/0227* (2013.01); *A24F 7/00* (2013.01); *H05B 3/44* (2013.01); *H05B 3/80* (2013.01); *H05B 2203/021* (2013.01)

(58) Field of Classification Search

CPC ..... A24F 47/00
USPC ..... 131/328–329
See application file for complete search history.

(56) References Cited

U.S. PATENT DOCUMENTS

2019/0124982 A1* 5/2019 Atkins ..... A24F 47/008

* cited by examiner

*Primary Examiner* — Phuong K Dinh

(57) ABSTRACT

The present invention relates to an e-cigarette with a plurality of heating components. The e-cigarette with a plurality of heating components is designed in the present invention, where the plurality of heating components are disposed in the atomization core, so that the e-cigarette produces more aerosol and meets user requirements; in addition, a plurality of liquid inlet holes are disposed in the atomization core, so that the e-liquid comes into contact fully with the heating components. This prevents the heating components from scorching due to insufficient e-liquid.

11 Claims, 6 Drawing Sheets

E-CIGARETTE WITH A PLURALITY OF HEATING COMPONENTS

CROSS-REFERENCE TO RELATED APPLICATIONS

The present application is a Continuation Application of PCT application No. PCT/CN2016/076249 filed on Mar. 14, 2016, which claims the benefit of Chinese Patent Application No. 201610070624.X filed on Feb. 1, 2016. The contents of all of the above are hereby incorporated by reference.

TECHNICAL FIELD

The present invention relates to the field of e-cigarettes, in particular to an e-cigarette with a plurality of heating components.

BACKGROUND

E-cigarettes, also known as electronic cigarettes, are mainly used to quit smoking and replace tobacco cigarettes. The e-cigarettes have similar appearance and taste to the tobacco cigarettes, but generally do not contain tar, suspended particles, and other harmful components found in the tobacco cigarettes. The e-cigarettes do not produce pervasive or lingering secondhand smoke.

Usually, e-liquid is diverted into a heating component and heated to produce aerosol. However, insufficient aerosol produced by an existing e-cigarette cannot meet user requirements. To resolve the foregoing problem, the e-cigarette is correspondingly improved in the following specific manners:

1. Increase the diameter of a hollow mini-hole of the heating component which the e-liquid passes through. However, this is not helpful for effective transformation of the e-liquid into aerosol, and the heating efficiency is low.

2. For the improvement in manner 1, increase the heating temperature of the heating component to improve the heating efficiency. However, power consumption is increased, and high-temperature heating is prone to make the e-cigarette overheated and even damage the e-cigarette.

3. Increase the length of the hollow mini-hole of the heating component which the aerosol passes through. However, an excessively long e-cigarette is not easy-to-use for the user.

How to make the e-cigarette produce more aerosol is one of the major subjects being studied by those skilled in the art.

SUMMARY

To overcome the foregoing defects of the prior art, a technical issue to be resolved in the present invention is to provide an e-cigarette with a plurality of heating components, so as to avoid insufficient aerosol produced by an existing e-cigarette.

A technical solution used to resolve the technical issue in the present invention is to provide an e-cigarette with a plurality of heating components, including a housing and a mouthpiece, where the mouthpiece is disposed at one end of the housing; and the e-cigarette further includes a liquid storage tank, an air passage, and an atomization core, where the atomization core includes a plurality of heating components and a holder, and the liquid storage tank, the air passage, and the atomization core are all disposed inside the housing;

for the liquid storage tank, where e-liquid is stored in the liquid storage tank;

for the air passage, where the air passage is disposed between the atomization core and the mouthpiece;

for the plurality of heating components, where the heating component includes a ceramic substrate, a heating filament, and connecting terminals, where the ceramic substrate is provided with a hollow mini-hole, the heating filament winds around the ceramic substrate, the connecting terminals are disposed at two ends of the ceramic substrate and are electrically connected to the heating filament, and the connecting terminal includes a terminal through-hole that cooperates with the hollow mini-hole; and for the holder, where the holder includes an upper holder, a lower holder, and a connecting plate, and the connecting plate is disposed between the upper holder and the lower holder; an air cavity is formed between the upper holder, the lower holder, and the connecting plate, and the heating component is disposed between the upper holder and the lower holder in a longitudinal direction, to be electrically connected to the upper holder and the lower holder; and the upper holder includes an upper liquid inlet hole separately communicating with the liquid storage tank and the hollow mini-hole and an upper air hole separately communicating with the air passage and the air cavity, so that the air cavity communicates with the outside.

An exemplary solution is that the lower holder includes a lower liquid inlet hole, and the lower liquid inlet hole separately communicates with the liquid storage tank and the hollow mini-hole.

An exemplary solution is that a liquid-guiding groove is disposed between the connecting plate and the housing, and the liquid-guiding groove communicates with the lower liquid inlet hole, so that the lower liquid inlet hole communicates with the liquid storage tank by using the liquid-guiding groove.

An exemplary solution is that the lower holder is disposed inside the connecting plate, and the connecting plate includes a connecting plate liquid inlet hole that cooperates with the lower liquid inlet hole.

An exemplary solution is that a sealing member is disposed between the lower holder and the heating component, a conductor passing through the sealing member is further disposed between the lower holder and the heating component, and the lower holder is electrically connected to the heating component by using the conductor.

An exemplary solution is that a liquid inlet groove is disposed at a liquid inlet opening of the upper liquid inlet hole.

An exemplary solution is that the upper holder is provided with a plurality of upper air holes, and a plurality of corresponding air passages are disposed between the upper air holes and the mouthpiece.

An exemplary solution is that the e-cigarette further includes a base, where the base is disposed at the other end of the housing, and an insulation member is disposed between the base and the lower holder.

An exemplary solution is that the base includes a base liquid inlet hole that cooperates with the lower liquid inlet hole.

An exemplary solution is that a second liquid storage tank is disposed between the base and the lower holder, the second liquid storage tank separately communicates with the base liquid inlet hole and the lower liquid inlet hole, the e-liquid sequentially passes through the liquid storage tank, the upper liquid inlet hole, the hollow mini-hole, the lower liquid inlet hole, the second liquid storage tank, the base liquid inlet hole, and the liquid-guiding groove, to implement e-liquid circulation.

Compared with the prior art, the present invention has following beneficial effects: The e-cigarette with a plurality of heating components is designed in the present invention, where the plurality of heating components are disposed in the atomization core, so that the e-cigarette produces more aerosol and meet user requirements; in addition, a plurality of liquid inlet holes are disposed in the atomization core, so that the e-liquid comes into contact fully with the heating component, preventing the heating component from scorching due to insufficient e-liquid.

BRIEF DESCRIPTION OF DRAWINGS

The following describes the present invention in more detail with reference to accompanying drawings and embodiments. In the accompanying drawings.

DESCRIPTION OF EMBODIMENTS

Figure 1:
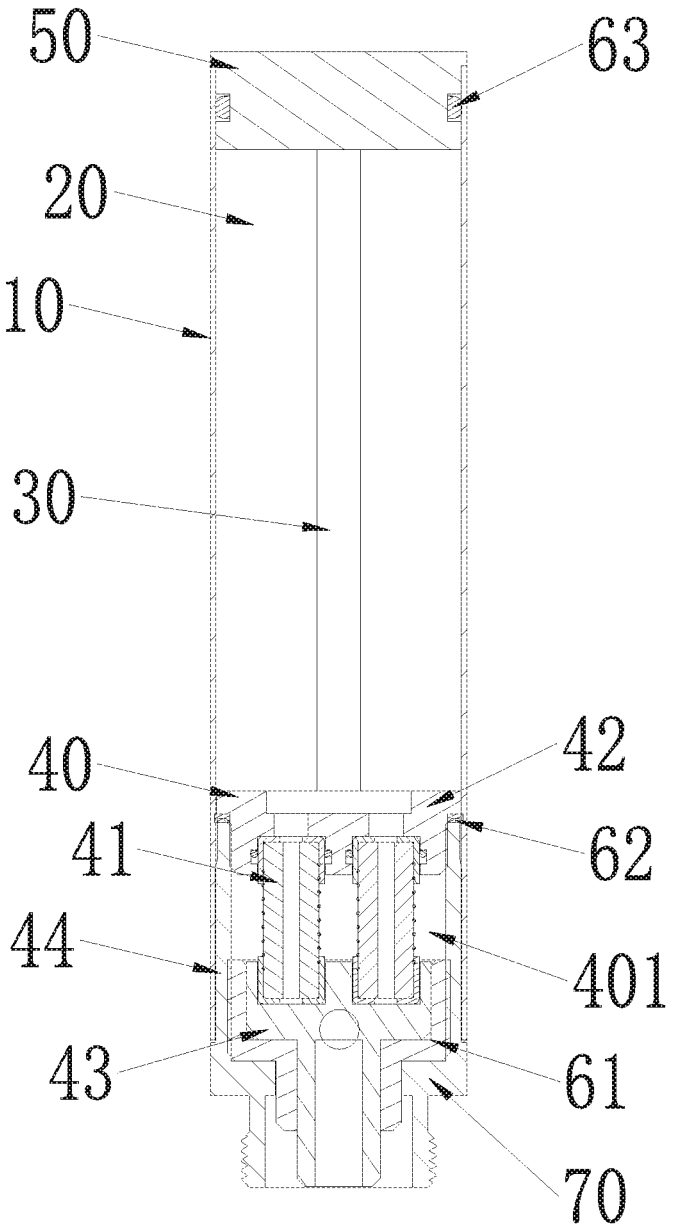
FIG. 1 is a schematic sectional structure diagram of an e-cigarette with a plurality of heating components according to the present invention.

Herein, exemplary embodiments of the present invention are described in detail with reference to the accompanying drawings.

As shown in FIG. 1 to FIG. 4, the present invention provides a preferred embodiment of an e-cigarette with a plurality of heating components.

An e-cigarette with a plurality of heating components 41 includes a housing 10 and a mouthpiece 50. The mouthpiece 50 is disposed at one end of the housing 10, and the e-cigarette further includes a liquid storage tank 20, an air passage 30, and an atomization core 40. The atomization core 40 includes a plurality of heating components 41 and a holder, and the liquid storage tank 20, the air passage 30, and the atomization core 40 are all disposed inside the housing 10. E-liquid is stored in the liquid storage tank 20. The air passage 30 is disposed between the atomization core 40 and the mouthpiece 50. The e-liquid of the liquid storage tank 20 enters the atomization core 40, and the atomization core 40 heats the e-liquid to produce aerosol. The aerosol sequentially passes through the air passage 30 and the mouthpiece 50 to the outside, that is, a user inhales the aerosol through the mouthpiece 50.

Figure 2:
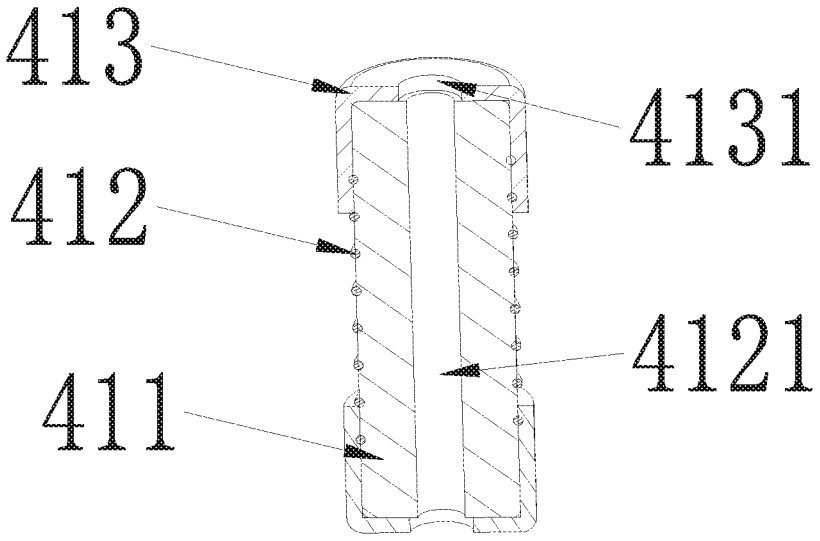
FIG. 2 is a schematic sectional structure diagram of a heating component according to the present invention.

For the heating component 41 in this embodiment, referring to FIG. 2, the plurality of heating components 41 are disposed in the atomization core 40, and each heating component 41 includes a ceramic substrate 411, a heating filament 412, and connecting terminals 413. The heating filament 412 winds around the ceramic substrate 411, the connecting terminals 413 are disposed at two ends of the ceramic substrate 411 and are electrically connected to the heating filament 412. The ceramic substrate 411 is provided with a hollow mini-hole 4121, and the connecting terminal 413 includes a terminal through-hole 4131 that cooperates with the hollow mini-hole 4121.

Specifically, the connecting terminals 413 are provided with opposite voltage. Heat is generated after the heating filament 412 is electrically connected. At the same time, the e-liquid of the liquid storage tank 20 enters the hollow mini-holes 4121 through the terminal through-hole 4131. Heat of the heating filament 412 turns the e-liquid into aerosol. The aerosol is emitted from the ceramic substrate 411 and sequentially passes through the air passage 30 and the mouthpiece 50 to the outside. The ceramic substrate 411 does not allow penetration of liquid. However, gas can be exchanged inside and outside the ceramic substrate 411.

For the holder in this embodiment, the holder forms an external supporting part of the atomization core 40. The holder includes an upper holder 42, a lower holder 43, and a connecting plate 44. The connecting plate 44 is disposed between the upper holder 42 and the lower holder 43. An air cavity 401 is formed between the upper holder 42, the lower holder 43, and the connecting plate 44. The heating component 41 is disposed between the upper holder 42 and the lower holder 43 in a longitudinal direction, that is, disposed within the air cavity 401, and is electrically connected to the upper holder 42 and the lower holder 43 by using the connecting terminals 413. In other words, the upper holder 42 and the lower holder 43 are conductive holders and provide opposite voltage. The upper holder 42 includes an upper liquid inlet hole 421 separately communicating with the liquid storage tank 20 and the hollow mini-hole 4121 and an upper air hole 422 separately communicating with the air passage 30 and the air cavity 401, so that the air cavity 401 communicates with the outside.

Figure 3:
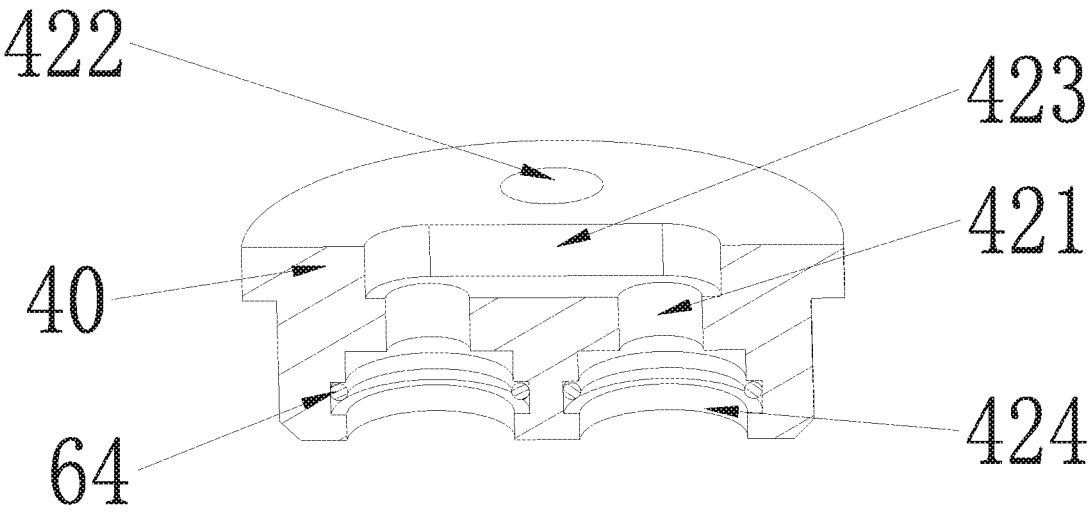
FIG. 3 is a schematic sectional structure diagram of an upper holder according to the present invention.

In the upper holder 42, referring to FIG. 3, the liquid storage tank 20, the upper liquid inlet hole 421, and the hollow mini-hole 4121 form a sealed space. The e-liquid of the liquid storage tank 20 enters the hollow mini-hole 4121 through the upper liquid inlet hole 421 and is heated to produce aerosol. The aerosol passes through the ceramic substrate 411 and enters the air cavity 401. In addition, the mouthpiece 50, the air passage 30, the upper air hole 422, and the air cavity 401 are sequentially communicated. During smoking, outside air enters the air cavity 401 and drives the aerosol to pass through the upper air hole 422, the air passage 30, and the mouthpiece 50 to reach the oral cavity of the human body. In order to prevent the e-liquid from entering the air cavity 401, the upper holder 42 is further provided with an accommodating groove 424 that is configured to accommodate one end of the heating component 41, so that the e-liquid smoothly enters the hollow mini-hole 4121.

Further, a sealing member is disposed between the air passage 30 and the upper air hole 422, to prevent the e-liquid from entering the air passage 30, the upper air hole 422, or the air cavity 401. In addition, a sealing member is disposed between the heating component 41 and the accommodating groove 424, where the sealing member is a fourth sealing ring 64, preferably a rubber seal ring.

Further, a liquid inlet groove 423 is disposed at a liquid inlet opening of the upper liquid inlet hole 421. When the atomization core 40 operates, the e-liquid successively enters the liquid inlet groove 423 and the upper liquid inlet hole 421 to feed the heating component 41. When an atomizer operates, the e-liquid in the liquid storage tank 20 enters the upper liquid inlet hole 421 while outside air enters the liquid storage tank 20 through the upper liquid inlet hole 421, to implement "exchange between the e-liquid and air". In this case, the upper liquid inlet hole 421 usually produces air bubbles; if the air bubbles are too large, the e-liquid is consequently blocked from entering the upper liquid inlet hole 421, to cause scorching of the heating component 41. In addition, in order to facilitate disposition of the liquid inlet groove 423, the upper liquid inlet hole 421 may be preferably disposed on the upper surface of the upper holder 42.

Further, a sealing member is disposed between the upper holder 42 and the connecting plate 44, where the sealing member is a second sealing ring 62 to prevent the e-liquid from overflowing, and the second sealing ring 62 abuts against the inside of the housing 10. Alternatively, seamless disposition is implemented between the upper holder 42 and the connecting plate 44; the second sealing ring 62 is disposed between the upper holder 42 and the inside of the housing 10, or the second sealing ring 62 is disposed between the connecting plate 44 and the inside of the housing 10.

Figure 4:
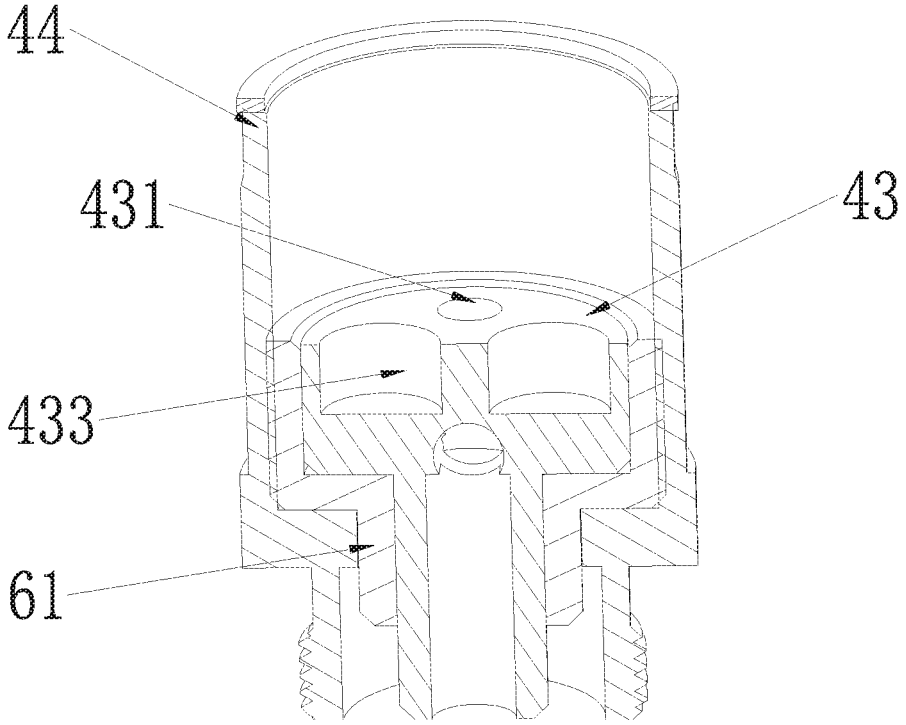
FIG. 4 is a schematic sectional structure diagram of an upper holder and a connecting plate according to the present invention.

In the lower holder 43 and the connecting plate 44, referring to FIG. 4, in order to prevent the e-liquid from entering the air cavity 401, the lower holder 43 is provided with an accommodating groove 433, configured to accommodate one end of the heating component 41. An insulation member 61 is disposed between the connecting plate 44 and the lower holder 43, and the insulation member 61 prevents electrical contact between the connecting plate 44 and the lower holder 43 and also ensures air tightness of the air cavity 401.

Further, the lower holder 43 further includes a lower air hole 431 in communication with the air cavity 401, and the lower air hole 431 communicates with the outside.

Further, the e-cigarette further includes a base 70, where the base 70 is disposed at the other end of the housing 10. In this embodiment, the connecting plate 44 and the base 70 are integrally designed.

In the foregoing embodiment, a fastening manner of the components is preferably a thread structure or snap-in (by snapping a small-diameter component into a large-diameter component), for example, between the base 70 and the housing 10, and between the mouthpiece 50 and the housing 10.

Figure 5:
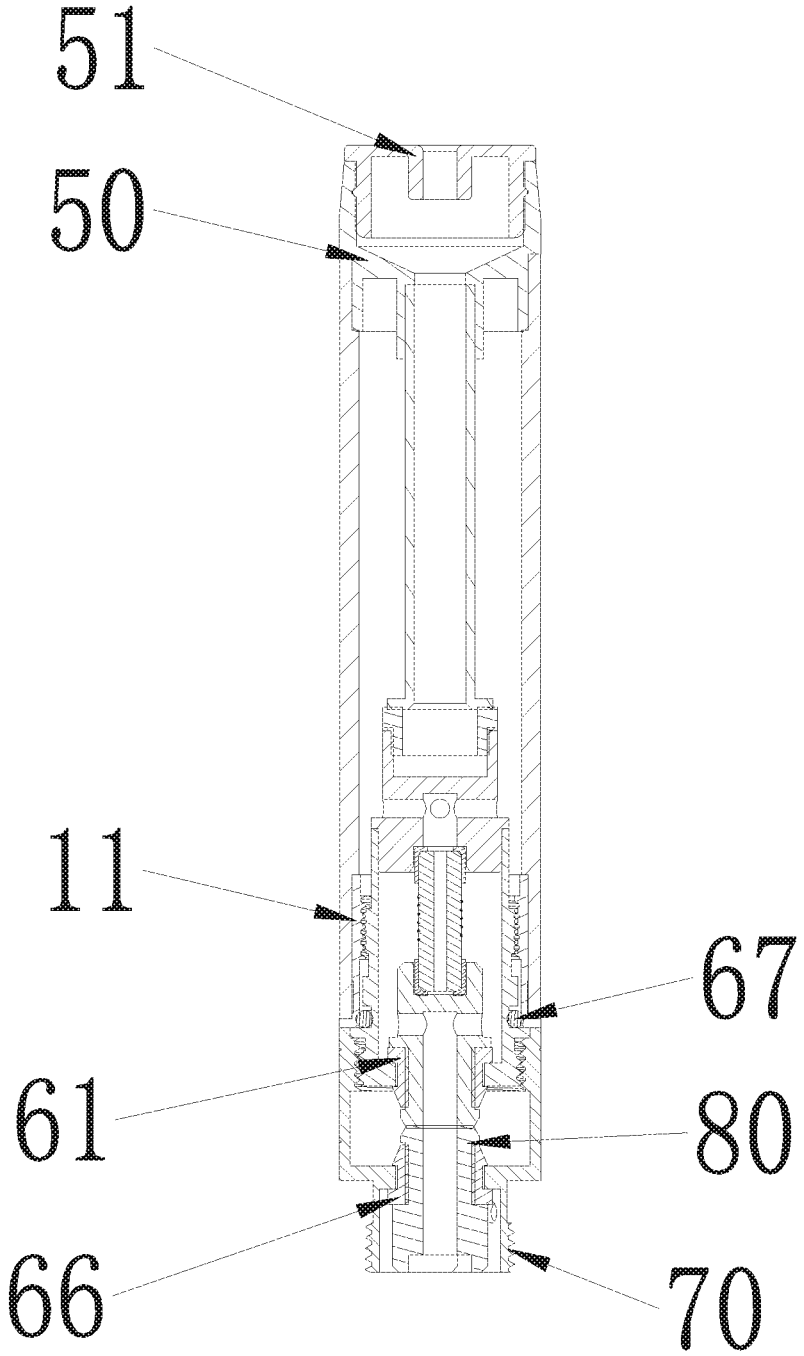
FIG. 5 is a schematic sectional structure diagram of another embodiment of an e-cigarette according to the present invention.

As shown in FIG. 5, the present invention also provides an exemplary embodiment of an e-cigarette.

A connecting piece 11 is disposed at the bottom of a housing 10. a connecting plate 44 is fastened inside the housing 10 by using the connecting piece 11. Preferably, a thread structure is disposed between the connecting plate 44 and the connecting piece 11, and a sealing member is further disposed between the connecting plate 44 and the connecting piece 11, where the sealing member is a seventh sealing member 67.

The e-cigarette further includes a base 70 and an electrode 80. The base 70 is fixedly connected to the connecting plate 44 and disposed at one end of the housing 10. The base 70 is connected to the electrode 80, and the electrode 80 is electrically connected to a lower holder 43 for electrical conduction. In addition, the electrode 80 further includes an air hole in communication with a lower air hole 431 to communicate with the outside. Further, a sealing member is disposed between the base 70 and the electrode 80, where the sealing member is a sixth sealing member 66, and the sixth sealing member 66 can also keep the electrode 80 steady.

The e-cigarette also includes a mouthpiece head 51 connected to a mouthpiece 50, to facilitate smoking of a user.

Figure 6:
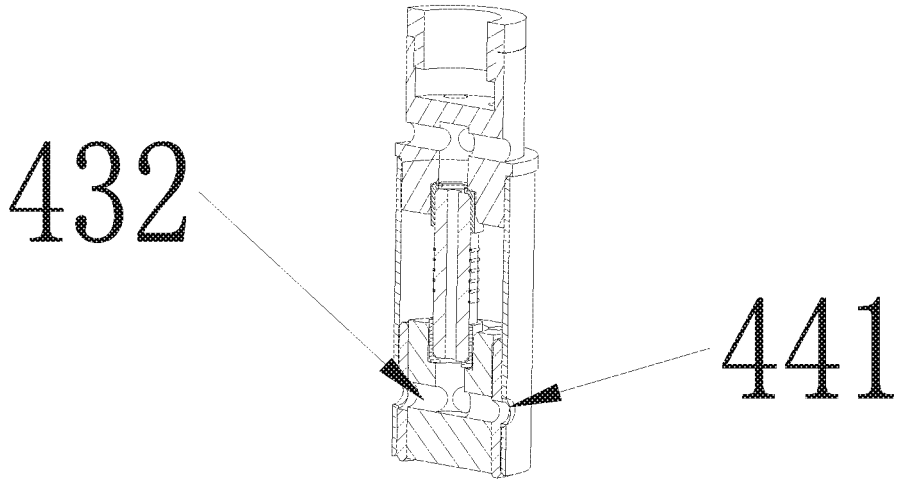
FIG. 6 is a schematic sectional structure diagram of an e-cigarette with a plurality of liquid inlet holes according to the present invention.
Figure 7:
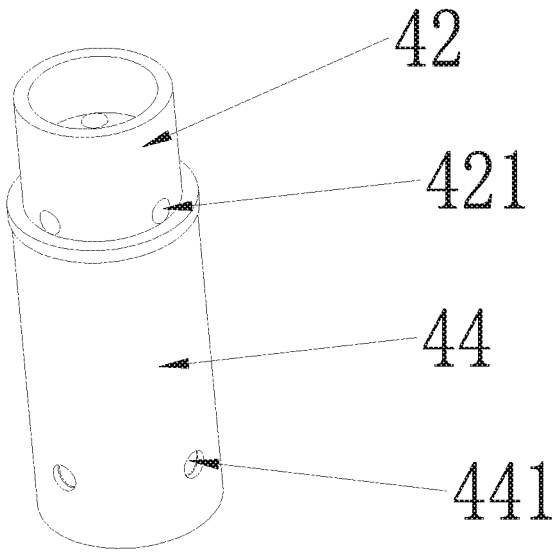
FIG. 7 is a schematic structural diagram of an e-cigarette with a plurality of liquid inlet holes according to the present invention.

As shown in FIG. 6 and FIG. 7, the present invention provides an exemplary embodiment of an atomization core with a plurality of liquid inlet holes.

A lower holder 43 includes a lower liquid inlet hole 432 separately communicating with a liquid storage tank 20 and a hollow mini-hole 4121. In addition, a liquid-guiding groove is disposed between a connecting plate 44 and a housing, and the lower liquid inlet hole 432 communicates with the liquid storage tank 20 through the liquid-guiding groove. That is, an liquid inlet hole is disposed at either of the upper and lower ends of an atomization core 40, so that e-liquid comes into contact fully with both ends of a heating component 41 to meet e-liquid supply requirements of a plurality of heating components 41. This prevents the heating components 41 from scorching due to insufficient e-liquid during operation.

Further, the lower holder 43 is disposed inside the connecting plate 44, and the connecting plate 44 includes a connecting plate liquid inlet hole 441 that cooperates with the lower liquid inlet hole 432.

Further, a liquid inlet groove 423 is disposed at a liquid inlet opening of the lower liquid inlet hole 432, or a liquid inlet groove 423 is disposed at a liquid inlet opening of the connecting plate liquid inlet hole 441.

Figure 8:
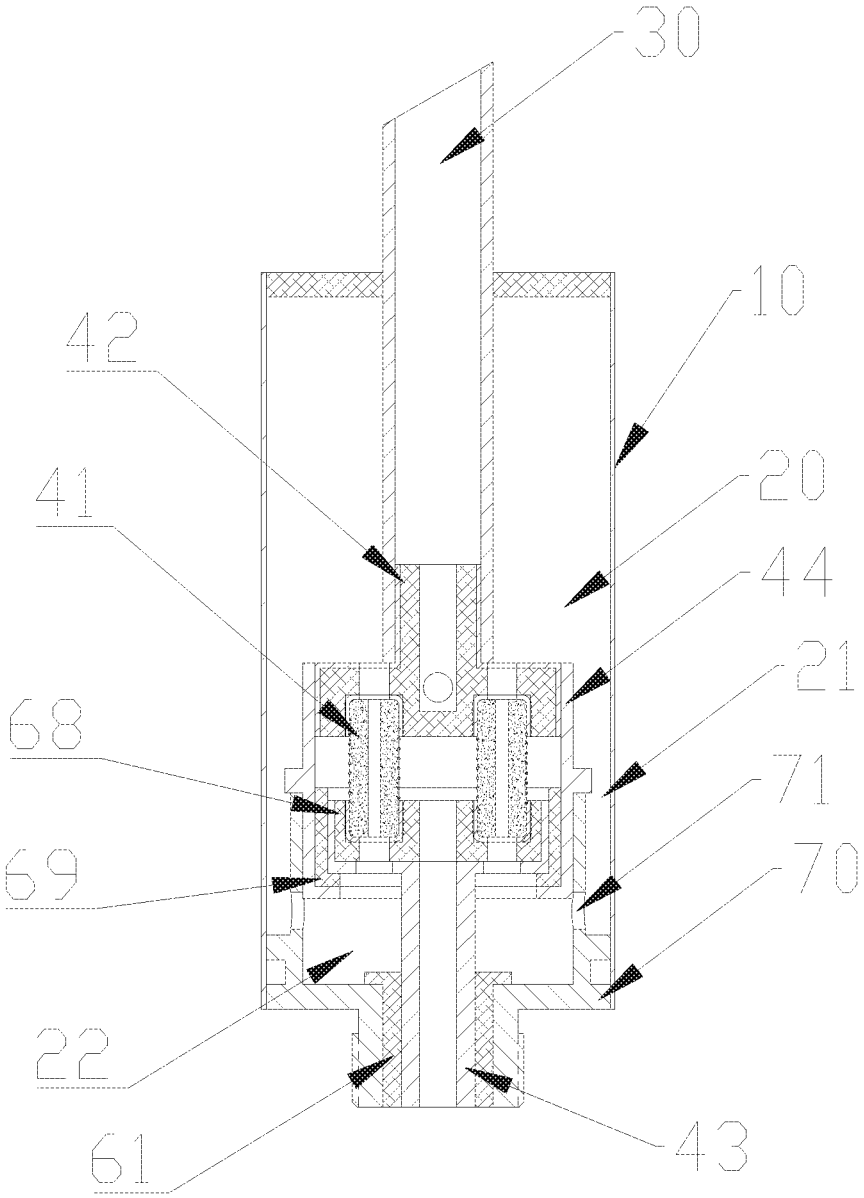
FIG. 8 is a schematic structural diagram of another embodiment of an e-cigarette according to the present invention.

As shown in FIG. 8, the present invention provides an exemplary embodiment of an e-cigarette with a detachable atomization core.

In the e-cigarette with a detachable atomization core, the atomization core 40 is designed to be detachable, facilitating replacement of related parts of the atomization core 40 and facilitate e-liquid refilling after the atomization core 40 is removed, thereby implementing recycling of the e-cigarette.

The e-cigarette with a detachable atomization core includes a housing 10, a liquid storage tank 20, an air passage 30, an atomization core 40, and a base 70. The atomization core 40 includes a heating component 41, an upper holder 42, a lower holder 43, and a connecting plate 44. The heating component 41 is disposed between the upper holder 42 and the lower holder 43. A liquid-guiding groove 21 is disposed between the connecting plate 44 and the housing 10, and the base 70 is disposed in cooperation with the connecting plate 44.

The base 70 includes a base liquid inlet hole 71 in cooperation with a lower liquid inlet hole 431. A second liquid storage tank 22 is formed between the base 70 and the lower holder 43, and the second liquid storage tank 22 separately communicates with the base liquid inlet hole 71 and the lower liquid inlet hole 431, and the e-liquid sequentially passes through the liquid storage tank 20, an upper liquid inlet hole 421, a hollow mini-hole 4121, the lower liquid inlet hole 431, the second liquid storage tank 22, the base liquid inlet hole 71, and the liquid-guiding groove 21, to implement e-liquid circulation.

Further, a sealing member is disposed between the lower holder 43 and the heating component 41, where the sealing member is an eighth sealing member 68 to isolate the lower holder 43 from the e-liquid of the heating component 41 and prevent heat conduction from the heating component 41. Therefore, a sealing insulation member is further disposed between the upper holder 42 and the heating component 41, to isolate the upper holder 42 from the e-liquid of the heating component 41 and prevent heat conduction from the heating component 41. In addition, a conductor (not shown in the figure) passing through the eighth sealing member 68 is further disposed between the lower holder 43 and the heating component 41. The conductor is preferably a wire, and the lower holder 43 is electrically connected to the heating component 41 by using the conductor. In other words, the lower holder 43, the conductor, and connecting terminals 413 are electrically connected.

Further, a ninth sealing member 69 is disposed between the lower holder 43 and the connecting plate 44 to prevent the e-liquid from flowing into an air cavity.

In this embodiment, an exemplary solution of refilling e-liquid is provided: Remove the base 70 from the housing 10, separate the base 70 from the atomization core 40, refill the e-liquid into the liquid storage tank 20 through the liquid-guiding groove 21, and reinstall the base 70. This implements recycling of the e-cigarette.

In this embodiment, an exemplary solution of replacing related parts of the atomization core 40 is provided. Referring to FIG. 8, the parts of the atomization core 40 can be replaced. Before replacement, the base 70 is removed from the housing 10, to separate the base 70 and the atomization core 40; the atomization core 40 is then removed from the housing 10 to separate the atomization core 40 and the air passage 30; after to-be-replaced parts of the atomization core 40, such as the heating component 41, the upper holder 42, the lower holder 43, the connecting plate 44, and even a sealing member disposed inside, are replaced, the atomization core 40 and the base 70 are reinstalled, to implement recycling of the e-cigarette.

The foregoing descriptions are merely exemplary embodiments of the present invention, but are not intended to limit the scope of the present invention. Any modification, equivalent replacement, or improvement made without departing from the application patent scope of the present invention should fall within the protection scope of the present invention.

What is claimed is:

1. An e-cigarette with a plurality of heating components, comprising a housing and a mouthpiece, wherein the mouthpiece is disposed at one end of the housing, and the e-cigarette further comprises a liquid storage tank, an air passage, and an atomization core, wherein the atomization core comprises a plurality of heating components and a holder, and the liquid storage tank, the air passage, and the atomization core are all disposed inside the housing;

wherein e-liquid is stored in the liquid storage tank;

wherein the air passage is disposed between the atomization core and the mouthpiece;

wherein the heating component comprises a ceramic substrate, a heating filament, and connecting terminals, wherein the ceramic substrate is provided with a hollow mini-hole, the heating filament winds around the ceramic substrate, the connecting terminals are disposed at two ends of the ceramic substrate and are electrically connected to the heating filament, and the connecting terminal comprises a terminal through-hole that cooperates with the hollow mini-hole; and wherein the holder comprises an upper holder, a lower holder, and a connecting plate, and the connecting plate is disposed between the upper holder and the lower holder; an air cavity is formed between the upper holder, the lower holder, and the connecting plate, and the heating component is disposed between the upper holder and the lower holder in a longitudinal direction, to be electrically connected to the upper holder and the lower holder; and the upper holder comprises an upper liquid inlet hole separately communicating with the liquid storage tank and the hollow mini-hole and an upper air hole separately communicating with the air passage and the air cavity, so that the air cavity communicates with the outside.

2. The e-cigarette according to claim 1, wherein the lower holder comprises a lower liquid inlet hole, and the lower liquid inlet hole separately communicates with the liquid storage tank and the hollow mini-hole.

3. The e-cigarette according to claim 2, wherein a liquid-guiding groove is disposed between the connecting plate and the housing, and the liquid-guiding groove communicates with the lower liquid inlet hole, so that the lower liquid inlet hole communicates with the liquid storage tank by using the liquid-guiding groove.

4. The e-cigarette according to claim 3, wherein the lower holder is disposed inside the connecting plate, and the connecting plate comprises a connecting plate liquid inlet hole that cooperates with the lower liquid inlet hole.

5. The e-cigarette according to claim 1, wherein a sealing member is disposed between the lower holder and the heating component, a conductor passing through the sealing member is further disposed between the lower holder and the heating component, and the lower holder is electrically connected to the heating component by using the conductor.

6. The e-cigarette according to claim 1, wherein a liquid inlet groove is disposed at a liquid inlet opening of the upper liquid inlet hole.

7. The e-cigarette according to claim 1, wherein the upper holder is provided with a plurality of upper air holes, and a plurality of corresponding air passages are disposed between the upper air holes and the mouthpiece.

8. The e-cigarette according to claim 1, further comprising a base, wherein the base is disposed at the other end of the housing, and an insulation member is disposed between the base and the lower holder.

9. The e-cigarette according to claim 3, further comprising a base, wherein the base is disposed at the other end of the housing, and an insulation member is disposed between the base and the lower holder.

10. The e-cigarette according to claim 8, wherein the base comprises a base liquid inlet hole that cooperates with the lower liquid inlet hole.

11. The e-cigarette according to claim 9, wherein a second liquid storage tank is disposed between the base and the lower holder, the second liquid storage tank separately communicates with the base liquid inlet hole and the lower liquid inlet hole, the e-liquid sequentially passes through the liquid storage tank, the upper liquid inlet hole, the hollow mini-hole, the lower liquid inlet hole, the second liquid storage tank, the base liquid inlet hole, and the liquid-guiding groove, to implement e-liquid circulation.

* * * * *